US008272146B1

(12) United States Patent
Jackson, II

(10) Patent No.: US 8,272,146 B1
(45) Date of Patent: Sep. 25, 2012

(54) SPRING-LOADED JUMPING SHOES

(76) Inventor: John R. Jackson, II, Fayetteville, NC (US)

( * ) Notice: Subject to any disclaimer, the term of this patent is extended or adjusted under 35 U.S.C. 154(b) by 214 days.

(21) Appl. No.: 12/851,367

(22) Filed: Aug. 5, 2010

(51) Int. Cl.
*A43B 13/28* (2006.01)

(52) U.S. Cl. ..... 36/27; 36/15; 36/28; 36/37

(58) Field of Classification Search ..... 36/27, 7.8, 36/15, 28, 29, 37, 38, 36 A–36 C, 36 R
See application file for complete search history.

(56) References Cited

U.S. PATENT DOCUMENTS

| | | | | |
|---|---|---|---|---|
| 3,219,358 | A * | 11/1965 | Hagner | 280/11.14 |
| 3,388,485 | A * | 6/1968 | Pierce | 36/7.8 |
| 3,538,628 | A * | 11/1970 | Einstein, Jr. | 36/15 |
| 3,875,688 | A | 4/1975 | McNaughton | |
| 3,977,094 | A | 8/1976 | Rivera et al. | |
| 3,996,677 | A | 12/1976 | Reina | |
| 4,296,557 | A | 10/1981 | Pajevic | |
| 4,457,084 | A | 7/1984 | Horibata et al. | |
| 4,660,299 | A | 4/1987 | Omilusik | |
| D307,608 | S | 5/1990 | Shure | |
| 5,337,492 | A * | 8/1994 | Anderie et al. | 36/28 |
| 5,435,079 | A | 7/1995 | Gallegos | |
| 5,621,984 | A | 4/1997 | Hsieh | |
| 5,752,329 | A * | 5/1998 | Horibata | 36/27 |
| D474,582 | S | 5/2003 | Cooper | |
| 6,996,922 | B2 * | 2/2006 | Ryoo | 36/7.8 |
| 7,441,347 | B2 * | 10/2008 | LeVert et al. | 36/27 |
| 7,500,324 | B1 * | 3/2009 | Power et al. | 36/132 |
| 7,937,853 | B2 * | 5/2011 | Kwon et al. | 36/27 |
| 2002/0053146 | A1 * | 5/2002 | Swigart | 36/29 |
| 2002/0083616 | A1 * | 7/2002 | Hajianpour | 36/7.8 |
| 2003/0009913 | A1 * | 1/2003 | Potter et al. | 36/29 |
| 2003/0101619 | A1 * | 6/2003 | Litchfield et al. | 36/29 |
| 2003/0217484 | A1 * | 11/2003 | Christensen et al. | 36/29 |
| 2005/0204584 | A1 * | 9/2005 | Ryoo | 36/27 |
| 2008/0216348 | A1 * | 9/2008 | Kwon et al. | 36/27 |
| 2009/0107006 | A1 * | 4/2009 | Ahn et al. | 36/27 |

* cited by examiner

*Primary Examiner* — Marie Patterson

(57) ABSTRACT

A spring-loaded jumping shoe featuring a shoe component comprising a sole, a top, and a foot hole; a track disposed in the sole of the shoe component; an attachment flange removably attached in the track in the sole of the shoe component; a generally flat base having a top surface, a bottom surface, an upwardly curved front end, and an upwardly curved back end; and at least a first hydraulic spring and a second hydraulic spring each extending upwardly from the base and sandwiched between the base and the attachment flange.

5 Claims, 4 Drawing Sheets

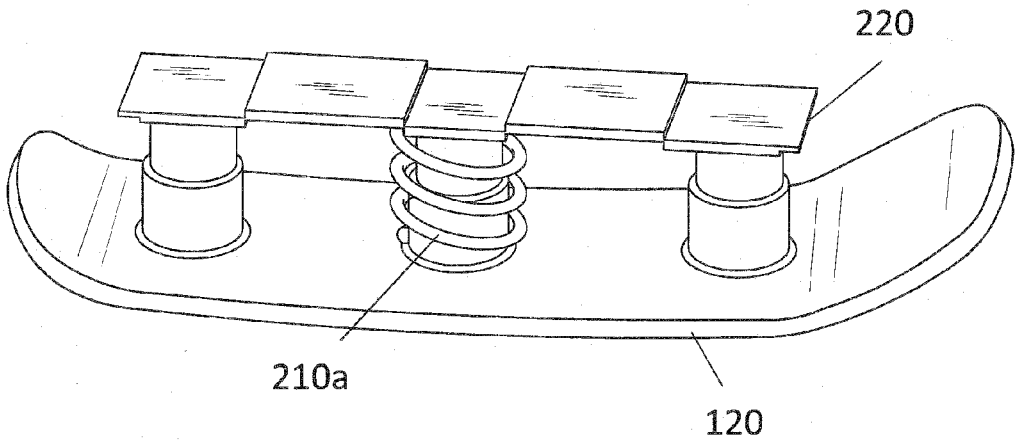
FIG. 2
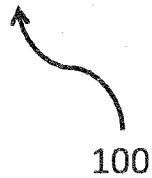

SPRING-LOADED JUMPING SHOES

FIELD OF THE INVENTION

The present invention is directed to modified shoes, more particularly to shoes that mimic jumping on a pogo stick, more particularly to shoes with spring-loaded hydraulic shocks.

BACKGROUND OF THE INVENTION

Jumping on a pogo stick can be very difficult and requires a great deal of practice. The present invention features a novel pair of shoes designed to mimic jumping on a pogo stick (e.g., provides a means of jumping on a spring-laded object). The spring-loaded jumping shoes of present invention also help provide users with a fun means of exercising. Generally, the spring-loaded jumping shoes of the present invention comprise spring-loaded hydraulic shocks.

Any feature or combination of features described herein are included within the scope of the present invention provided that the features included in any such combination are not mutually inconsistent as will be apparent from the context, this specification, and the knowledge of one of ordinary skill in the art. Additional advantages and aspects of the present invention are apparent in the following detailed description and claims.

SUMMARY

The present invention features a spring-loaded jumping shoe. In some embodiments, the spring-loaded jumping shoe comprises a shoe component comprising a sole, a top, and a foot hole; a track disposed in the sole of the shoe component; an attachment flange removably attached in the track in the sole of the shoe component; a generally flat base having a top surface, a bottom surface, an upwardly curved front end, and an upwardly curved back end; and at least a first hydraulic spring and a second hydraulic spring each extending upwardly from the base and sandwiched between the base and the attachment flange.

In some embodiments, the spring-loaded jumping shoe further comprises one or more light components disposed on the shoe component. In some embodiments, the light components are activated upon compression of the first hydraulic spring or second hydraulic spring. In some embodiments, the base further comprises treads or grips. In some embodiments, the base is generally flexible.

BRIEF DESCRIPTION OF THE DRAWINGS

FIG. 2 is a perspective view of the components of the spring-loaded jumping shoe of FIG. 1.

DESCRIPTION OF PREFERRED EMBODIMENTS

Figure 1:
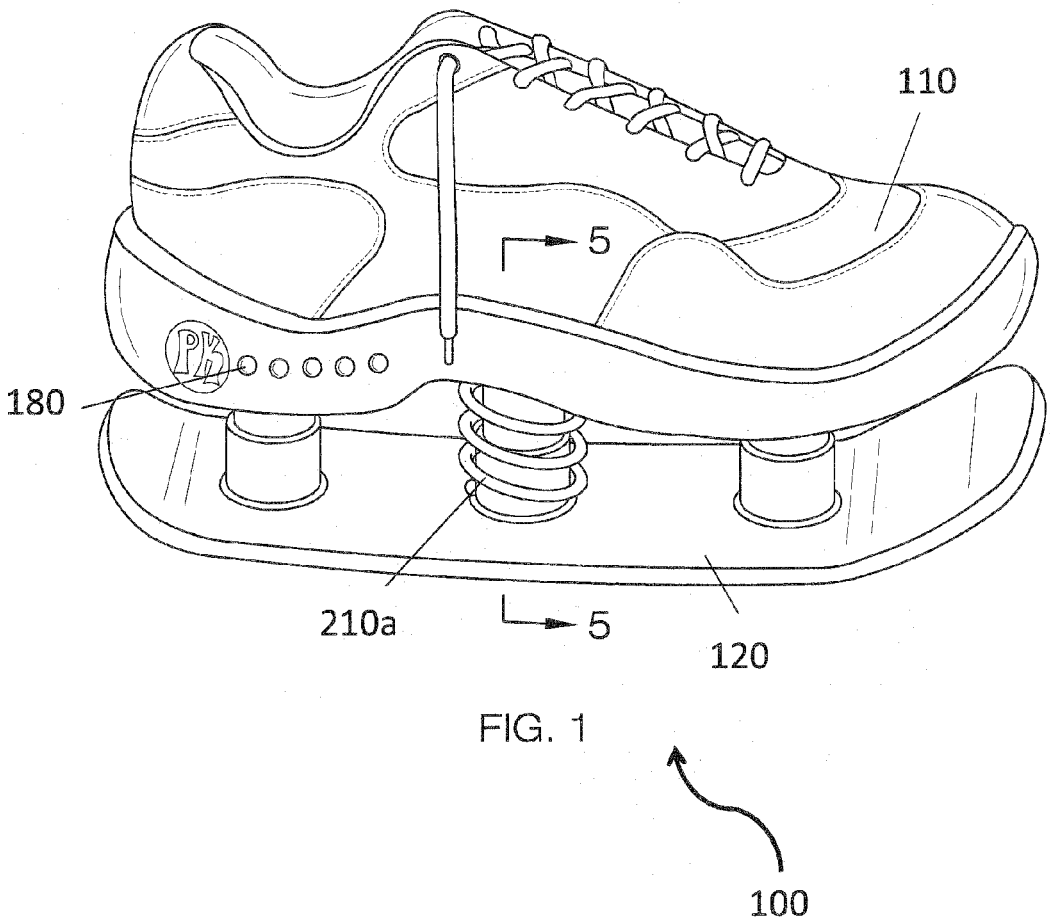
FIG. 1 is a perspective view of a spring-loaded jumping shoe of the present invention.

Referring now to FIGS. 1-5, the present invention features spring-loaded jumping shoes 100, which generally provide a feeling of jumping on a spring-loaded object (e.g., like a pogo stick). In some embodiments, the jumping shoe 100 comprises a shoe component, e.g., as shown in FIG. 1, and in some embodiments, the jumping shoe 100 lacks the shoe component but is adapted to be attached to a standard shoe, e.g., as shown in FIG. 2.

As shown in FIG. 1, the jumping shoe 100 may comprise a shoe component 110, which resembles a standard shoe such as a sneaker. Such standard shoes are well known to one of ordinary skill in the art. For example, the shoe component 110 comprises a sole 114, a tip, a foot hole, a tongue, in some embodiments laces, etc.

The jumping shoe 100 further comprises a base 120, which is positioned below the shoe component 110 (e.g., generally parallel to the sole 114 of the shoe component 110). The base 120 may be generally flat having a top surface and a bottom surface, as well as a front end, a back end, a first side edge, and a second side edge. In some embodiments, the front end and the back end curve upwardly.

The jumping shoe 100 of the present invention further comprises one or more hydraulic springs 210. Hydraulic springs are well known to one of ordinary skill in the art. For example, the jumping shoe 100 of the present invention further comprises a first hydraulic spring 210*a* which extends upwardly from the base 120 (see FIG. 2). In some embodiments, the first hydraulic spring 210*a* extends upwardly from the base 120 to an attachment flange 220, the attachment flange 220 functioning to bind to the sole of the shoe component 110. The attachment flange 220 and the base 120 may sandwich the first hydraulic spring 210*a*. In some embodiments, the first hydraulic spring 210*a* extends upwardly from the base 110 to the sole 114 of the shoe component 110 (e.g., the sole 114 of the shoe component 110 and the base 120 sandwich the first hydraulic spring 210*a*).

Figure 4:
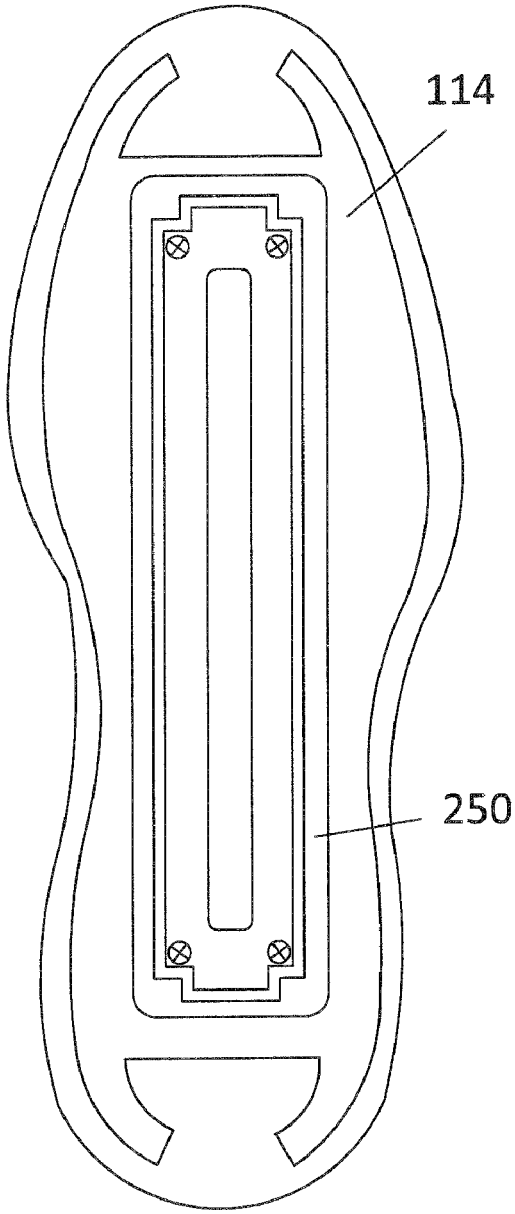
FIG. 4 is a bottom view of the shoe component of the spring-loaded jumping shoe of FIG. 1.
Figure 5:
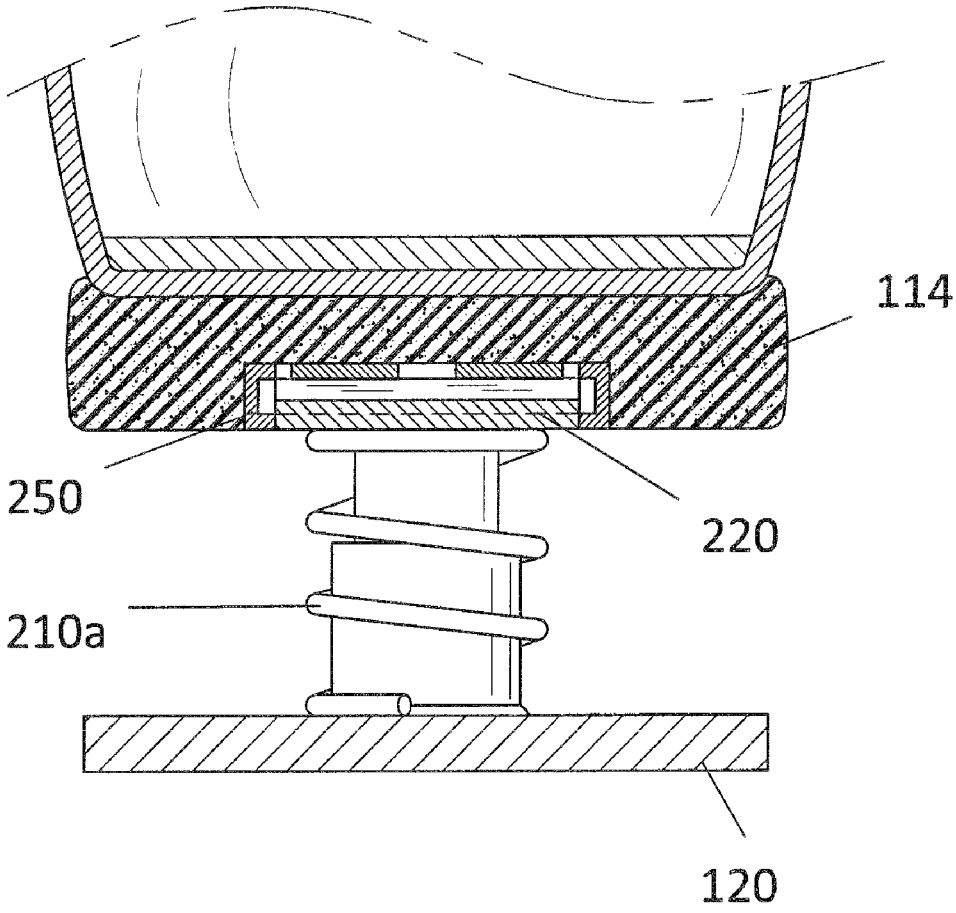
FIG. 5 is a back cross sectional view of the spring-loaded jumping shoe of FIG. 1.

In some embodiments, the jumping shoe 100 comprises a first hydraulic spring 210*a*, a second hydraulic spring, and a third hydraulic spring, each sandwiched between the base 120 and either the attachment flange 220 or the sole 114 of the shoe component 110. As shown in FIG. 4, the attachment flange 220 may engage a track 250 disposed in the sole 114 of the shoe component 110.

In some embodiments, the jumping shoe 100 further comprises one or more light components 180 (e.g. light emitting diodes (LEDs)). The light components 180 may be disposed on the shoe component 110, for example on the sole 114. The light components 180 may be activated upon jumping, for example, the light components 180 may be operatively connected to the hydraulic spring 210*a*. When the hydraulic spring 210*a* is compressed the light components 180 become illuminated.

Figure 3:
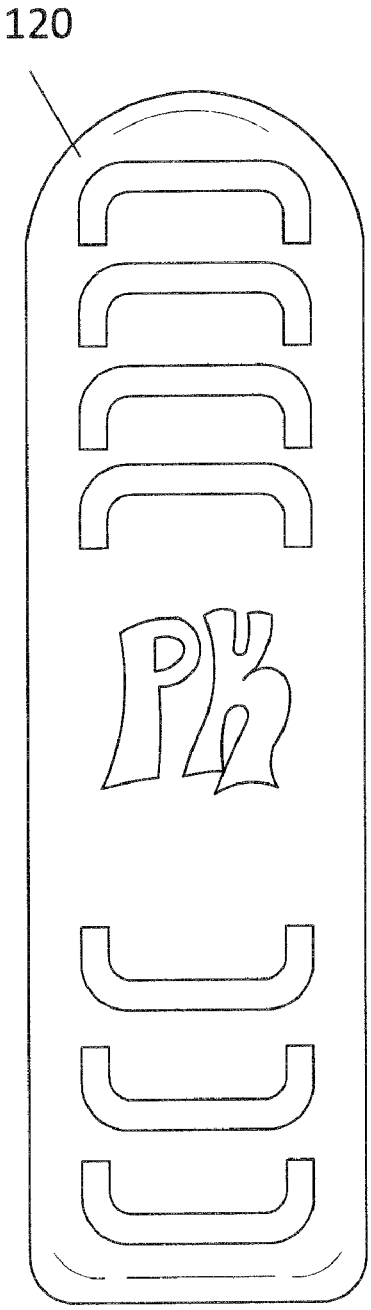
FIG. 3 is a bottom view of the base of the spring-loaded jumping shoe of FIG. 1.

Referring now to FIG. 3, the base 120 of the jumping shoe 100 of the present invention may comprise treads, grips, or the like disposed on the bottom surface of the base 120. In some embodiments, the base 120 (the bottom surface) may resemble a ski. In some embodiments, the base 120 is generally flexible.

Without wishing to limit the present invention to any theory or mechanism, it is believed that the jumping shoes 100 of the present invention are advantageous because the attachment flange allows for removing of the hydraulic springs 210 and base 120, the base 120 is generally flexible, and the shoes 100 comprise light components 180.

The disclosures of the following U.S. patents are incorporated in their entirety by reference herein: U.S. Pat. No. 4,296,557; U.S. Pat. No. 3,875,688; U.S. Pat. No. 4,457,084; U.S. Pat. No. 3,977,094; U.S. Pat. No. 5,621,984; U.S. Pat. No. 3,996,677; U.S. Pat. No. 5,435,079; U.S. Pat. No. 4,660,299.

Various modifications of the invention, in addition to those described herein, will be apparent to those skilled in the art from the foregoing description. Such modifications are also intended to fall within the scope of the appended claims. Each reference cited in the present application is incorporated herein by reference in its entirety.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims.

What is claimed is:

1. A spring-loaded jumping shoe comprising:

(a) a shoe component comprising a sole, a top, and a foot hole;

(b) a track disposed in the sole of the shoe component;

(c) an attachment flange removably attached in the track in the sole of the shoe component;

(d) a generally flat base having a top surface, a bottom surface, an upwardly curved front end, and an upwardly curved back end; and (e) at least a first hydraulic spring and a second hydraulic spring each extending upwardly from the base and sandwiched between the base and the attachment flange.

2. The spring-loaded jumping shoe of claim 1 further comprising one or more light components disposed on the shoe component.

3. The spring-loaded jumping shoe of claim 2, wherein the light components are activated upon compression of the first hydraulic spring or second hydraulic spring.

4. The spring-loaded jumping shoe of claim 1, wherein the base further comprises treads or grips.

5. The spring-loaded jumping shoe of claim 1, wherein the base is generally flexible.

* * * * *